US007730820B2

(12) United States Patent
Vice et al.

(10) Patent No.: US 7,730,820 B2
(45) Date of Patent: Jun. 8, 2010

(54) MOUNTED ISOMETRIC CONTROLLER

(75) Inventors: Jack M. Vice, Washington, DC (US); Joli K. Rightmyer, Arlington, VA (US)

(73) Assignee: Anthrotronix, Inc., Silver Spring, MD (US)

( * ) Notice: Subject to any disclaimer, the term of this patent is extended or adjusted under 35 U.S.C. 154(b) by 227 days.

(21) Appl. No.: 11/458,087

(22) Filed: Jul. 17, 2006

(65) Prior Publication Data

US 2008/0010890 A1 Jan. 17, 2008

(51) Int. Cl.
*F41A 17/20* (2006.01)

(52) U.S. Cl. ..... 89/1.42; 42/70.01

(58) Field of Classification Search ..... 42/71.02, 42/72, 73, 70.08, 70.01, 70.06, 70.09; 89/1.42, 89/27.3

See application file for complete search history.

(56) References Cited

U.S. PATENT DOCUMENTS 5,044,107 A 9/1991 Holford
5,555,662 A 9/1996 Teetzel
5,822,905 A 10/1998 Teetzel
5,937,557 A * 8/1999 Bowker et al. ..... 42/70.01
6,070,355 A 6/2000 Day
6,192,614 B1 2/2001 Cliburn
6,385,894 B1 5/2002 Podvin
6,421,943 B1 * 7/2002 Caulfield et al. ..... 42/70.11
6,548,982 B1 4/2003 Papanikolopoulos et al.
6,631,579 B1 * 10/2003 Lauster et al. ..... 42/70.11
6,823,621 B2 * 11/2004 Gotfried ..... 42/70.06
6,931,775 B2 8/2005 Burnett
2002/0178635 A1 * 12/2002 Martin ..... 42/70.11
2003/0098774 A1 * 5/2003 Chornenky ..... 340/5.1
2003/0226305 A1 12/2003 Burnett
2005/0115140 A1 6/2005 Little

FOREIGN PATENT DOCUMENTS

WO WO 2003/104836 12/2003

* cited by examiner

*Primary Examiner*—Stephen M Johnson
(74) *Attorney, Agent, or Firm*—Lieberman & Brandsdorfer, LLC

(57) ABSTRACT

A method and system are provided to support simultaneous operation of a weapon and communication with a remote apparatus. The system utilizes a control module with a transceiver in communication with a receiver of a remote apparatus and/or output device.

18 Claims, 6 Drawing Sheets

MOUNTED ISOMETRIC CONTROLLER

BACKGROUND OF THE INVENTION

1. Technical Field

This invention relates to a weapon communication system. More specifically, the communication system supports use of the weapon while communicating with a remote apparatus.

2. Description of the Prior Art

The ability of a remote apparatus to effectively achieve its targeted tasks is dependent, in large part, on communication systems and a user interface. The human machine interface and related controls are critical to successful tele-operated and semi-autonomous operations. The human operator has the adaptability needed in a dynamic, unpredictable environment. However, the operator's cognitive, motor, and peripheral senses are limited even under optimal conditions. Accordingly, designing the remote apparatus platform control interface and integrating this interface must take into consideration these limitations in order to optimize the quality and effectiveness of the human/machine interface.

One objective to optimize the quality and effectiveness of the human-machine interface is for the user interface to provide a wide range of human/robot interaction modalities. For example, when interacting with a fully autonomous tactile mobile robot or unmanned vehicle, the communication from the robot may merely consist of a situation report at a way point. In this case, the human response could be a software recognized hand signal instructing the robot to continue on to the next way point. Conversely, the other end of the spectrum of interaction modalities occurs when autonomous functionality is not appropriate or not operational. Non-autonomous interaction would likely require a live video feed from the robot as well as telemetry data. The operator would need to directly control the mobility of the robot with some type of proportional input, such as a small joystick or tactile sensor.

Accordingly, there is a need for a system that supports control of a remote apparatus while supporting motor skills and cognitive abilities of the operator.

SUMMARY OF THE INVENTION

This invention comprises an apparatus and method for a weapons mounted communication system.

In one aspect of the invention, an apparatus is provided with a control module operable to generate at least one signal for transmission to a processing unit. The control module is mountable on a weapon. The control modules includes a housing that is configured as a vertical handgrip of the weapon with an electronic communication circuit mounted within the housing. An input device is coupled to an electronic input circuit and is mounted on the housing so as to enable the operator of the module to simultaneously operate the weapon and provide input to the processing unit. In addition, a receiver is provided to communicate with the processing unit to receive data generated by the input device and to convey the received data in a tactile format to an output device that is in communication with the processing unit.

In another aspect of the invention, a communication system is provided with a transceiver in the form of a control module mountable to a weapon and a receiver in the form of a processing unit in communication with the transceiver. An input device is present in the system and coupled to the transceiver. The input device supports simultaneous operation of both the weapon and the processing unit. In addition, a tactile output device is provided in communication with the transceiver to provide tactile output to an operator in response to a signal received from the transceiver.

Other features and advantages of this invention will become apparent from the following detailed description of the presently preferred embodiment of the invention, taken in conjunction with the accompanying drawings.

DESCRIPTION OF THE PREFERRED EMBODIMENT(S)

Overview

The mounted isometric controller (MIC) is a control module in the form of an isometric joystick mounted to a weapon. The control module generates communication signals that are received by a processing unit that may be remote from or local to the module. The control module is mountable on the weapon and is also detachable from the weapon, and is operable in both positions. When the control module is in a position in which it is mounted to the weapon, it supports simultaneous operation of the weapon and input to the processing unit. The control module is isometric in that it detects forces applied by the user without moving at such time as it is in a mounted position. Similarly, when the control module is detached from the weapon, it maintains communication with the processing unit.

Technical Details

Figure 1A:
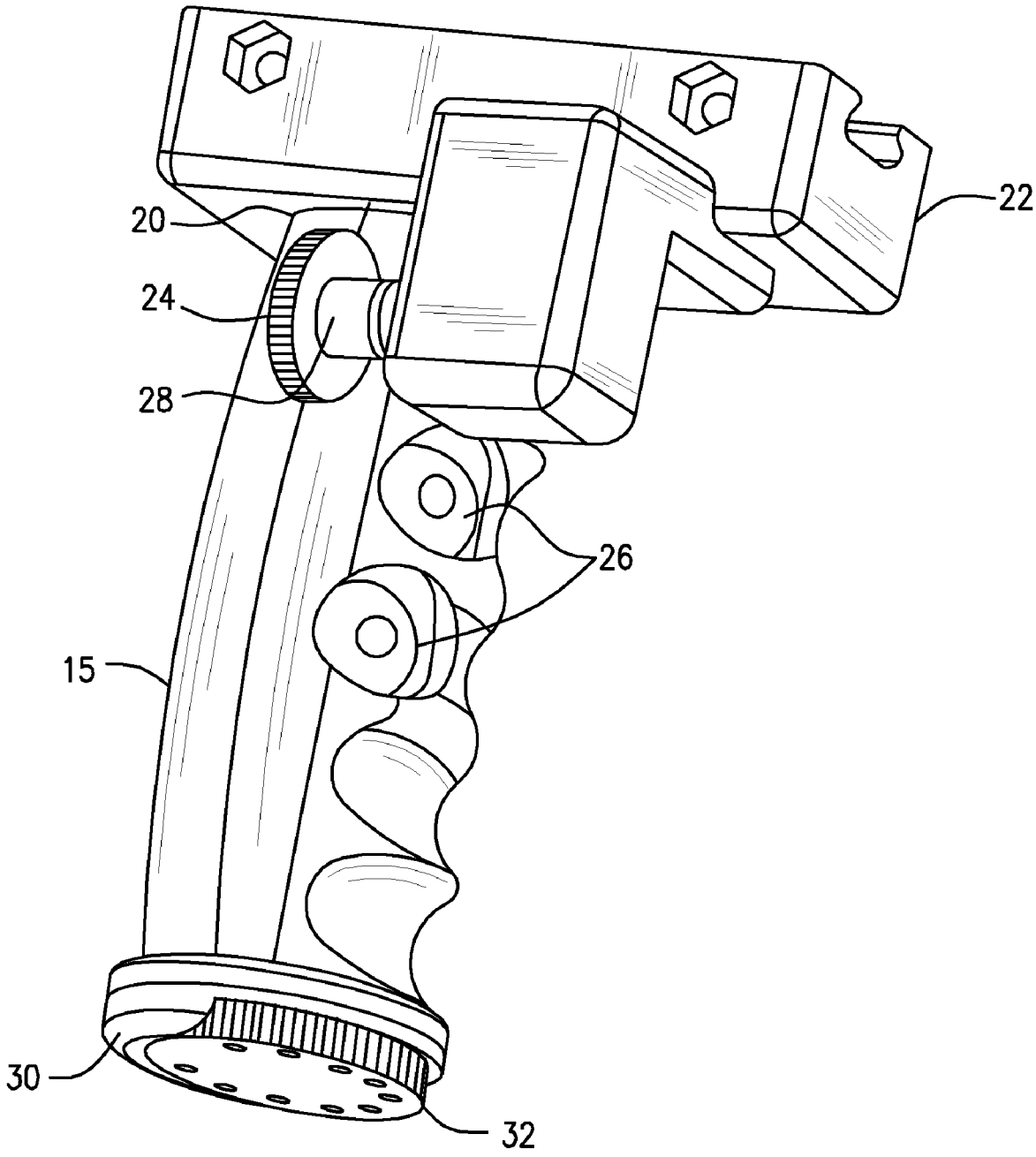
FIG. 1A is a perspective view of the control module in a detached position according to the preferred embodiment of this invention, and is suggested for printing on the first page of the issued patent.

The mounted isometric controller (MIC) consists of a control module having vertical body that is mountable to a rail attachment of a weapon. In a mounted position, the MIC may be used as a hand grip to hold the weapon in a set position for firing, and at the same time, it may be used as a control module for communicating with a processing unit. In one embodiment, the processing unit may be a personal digital assistant, a remote apparatus, or an interface. FIG. 1A is a perspective view of the control module (10) in a detached position from the weapon (not shown). As shown, the control module has an elongate body (15) with a top surface (20) and a bottom surface (30). In one embodiment, the top surface (20) of the body attaches to a secondary surface, such as a weapon rail attachment. The elongate body (15) includes control elements to enable communication with a remote apparatus (not shown). In one embodiment, one such control elements may be in the form of a load sensing cell (40), shown in detail in FIG. 1C, mounted at the interface of the vertical body (15)

and the weapon rail attachment (not shown). Upon attachment of the control module (10) to a secondary surface, such as a rail attachment (22) for a weapon, the load sensing cell functions as an input for data related to forces applied to the elongate body (15). In one embodiment, the load sensing cell is an input sensor that detects proportional data in up to six axis, including force along three of the axis and torque along three of the axis. Data received by the load sensing cell is proportional data pertaining to forces applied to the elongate body (15). Accordingly, at such time as the control module is secured to the weapon, data gathered by the load sensing cell (40) is communicated to the remote apparatus.

Figure 5:
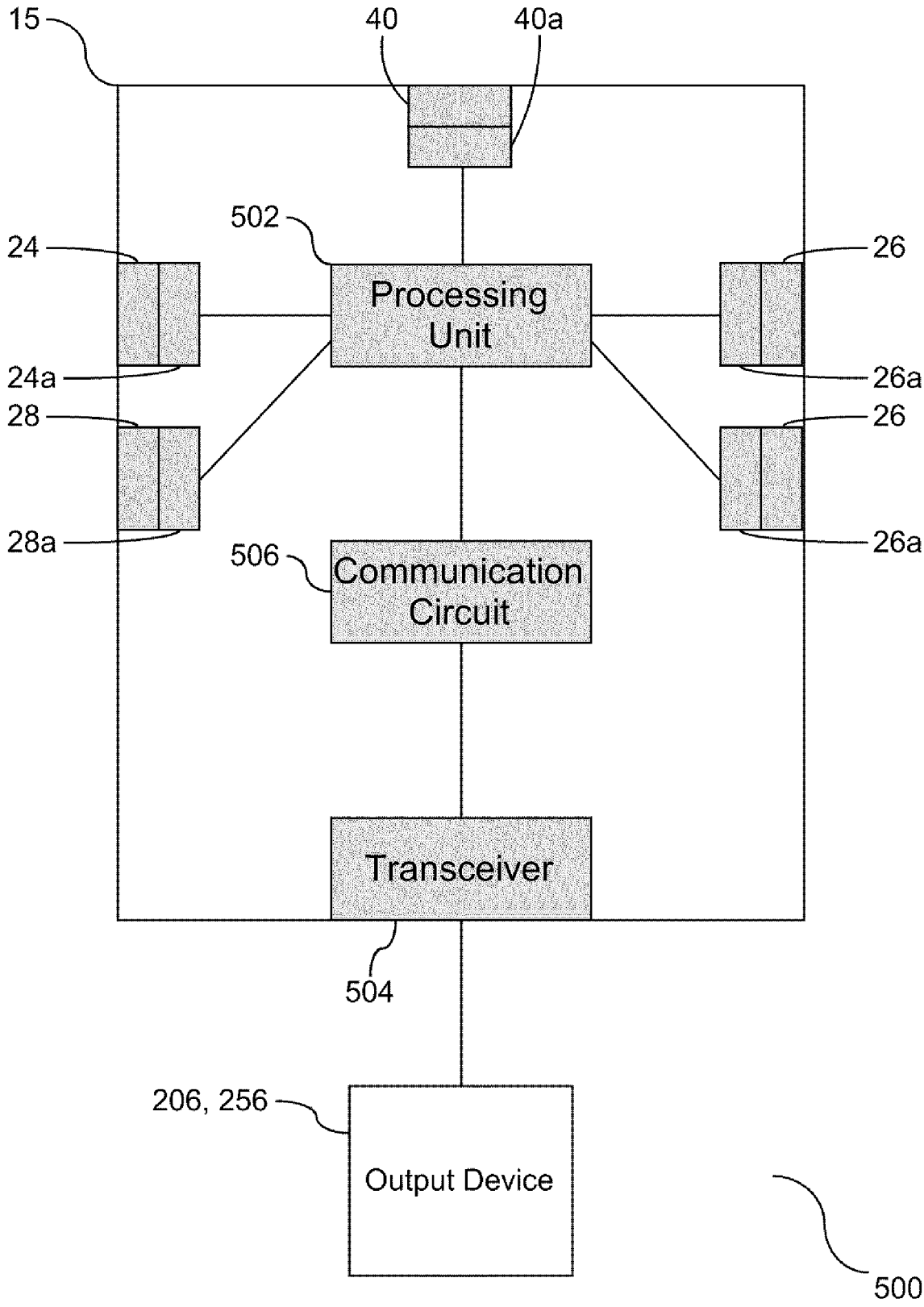
FIG. 5 is a schematic diagram of the control module of FIG. 1A.

FIG. 5 is a schematic diagram (500) of the control module (10). More specifically, FIG. 5 shows the capacitive sensor (24), the input sensors (26), the isometric joystick (28), and the load sensing cell (40), all in communication with a respective electronic input circuit (24*a*), (26*a*), (28*a*) and (40*a*), and the processing unit (502). The processing unit (502) is in communication with a communication circuit (506), and transceiver (504). The transceiver (504) sends and receives data between the control module (10) and an output device (206), (256).

Additional control input elements for communicating with a processing unit are spaced apart along the length of the elongate body (15) between the top surface (20) and the bottom surface (30). The control input elements include a capacitive sensor (24), a set of input sensors (26), an isometric joystick (28), and a tactile controller (32). The capacitive sensor (24) activates a controller for the control module when an operator has a finger on or within close proximity to the sensor (24). Similarly, the capacitive sensor (24) deactivates the controller for the control module when the finger of the operator is not in close proximity to the sensor (24). In one embodiment, the capacitive sensor (24) is sized and positioned to receive the thumb of the operator. Situations that may result in removal of the thumb from the capacitive sensor include non-use of the weapon, or movement of the thumb of the operator into a firing position. Accordingly, the capacitive sensor (24) functions to enable or disable communication of data generated from one or more sensors of the elongate body (15) or forces on the elongate body (15) as read by the load sensing cell based upon how fingers of a soldier or other user are positioned with respect to the capacitive sensor (24).

In addition to the capacitive sensor (24), sensors (26) are spaced at preset intervals along the length of the vertical body (15). In one embodiment, the sensors (26) are binary buttons in communication with the controller to communicate binary data via a transceiver (not shown) based upon depression of the buttons. The sensors (26) may be mounted with respect to the control module in one of three positions, raised, flush, or recessed. The recessed position of the sensors (26) allow the fingers of the operator to bridge over the sensors (26) unimpeded when the operator is using the control module body (15) to fire the weapon. At the same time, the recessed nature of the sensors (26) allows for easy access when the vertical body (15) is being used as a controller in communication with a remote apparatus. In addition to the sensors (26), a secondary joystick (28) is provided along the body of the control module (15) to communicate with the processing unit (502). The secondary joystick (28) is an input device to communicate proportional data with the processing unit (502). In one embodiment, the secondary joystick (28) is comfortably accessible to the user's thumb and is mounted on an upper rail attachment element to provide to minimize unintended forces on the load sensing cell (40) of the elongate body.

Figure 1B:
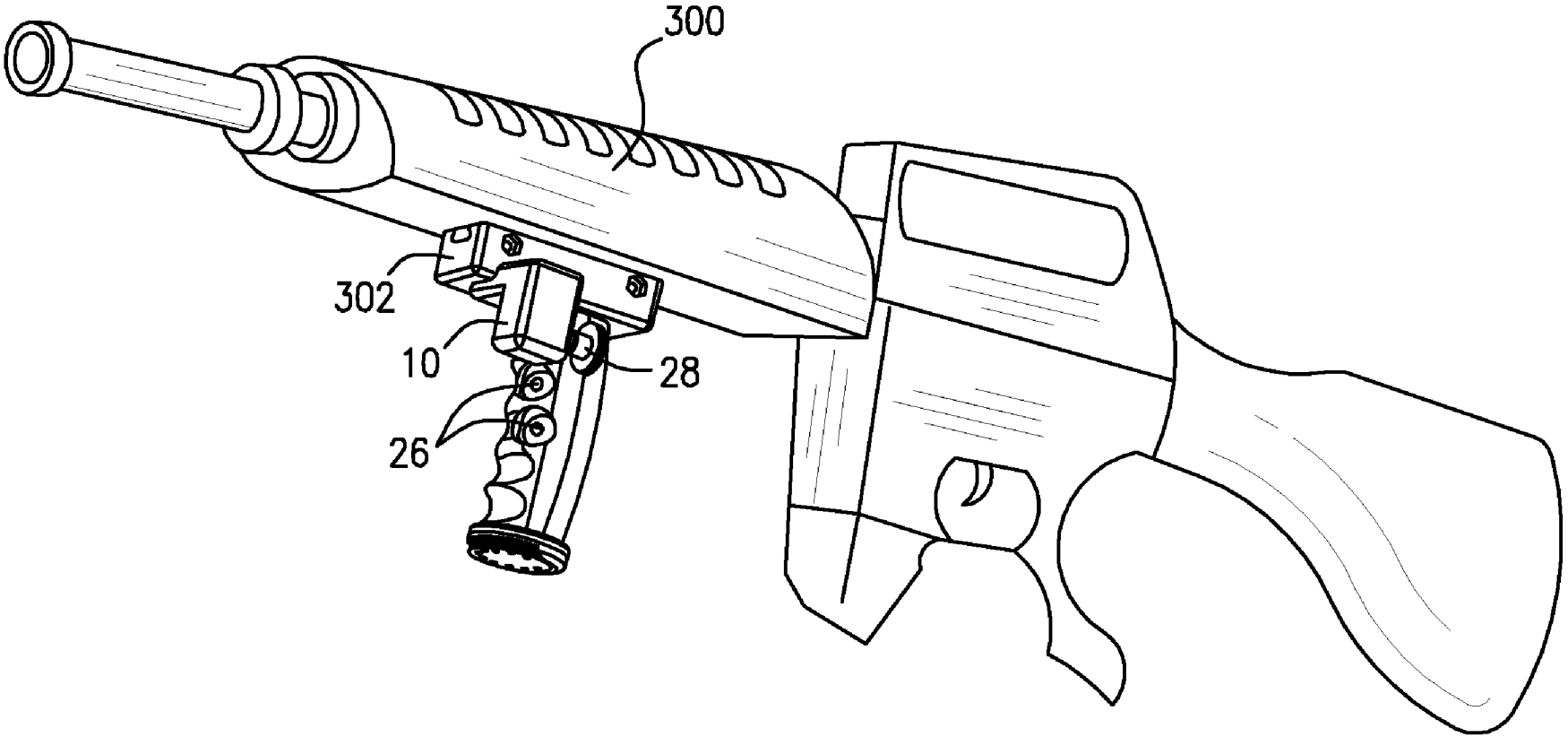
FIG. 1B is a side elevational view of the control module of FIG. 1A mounted to a weapon.
Figure 1C:
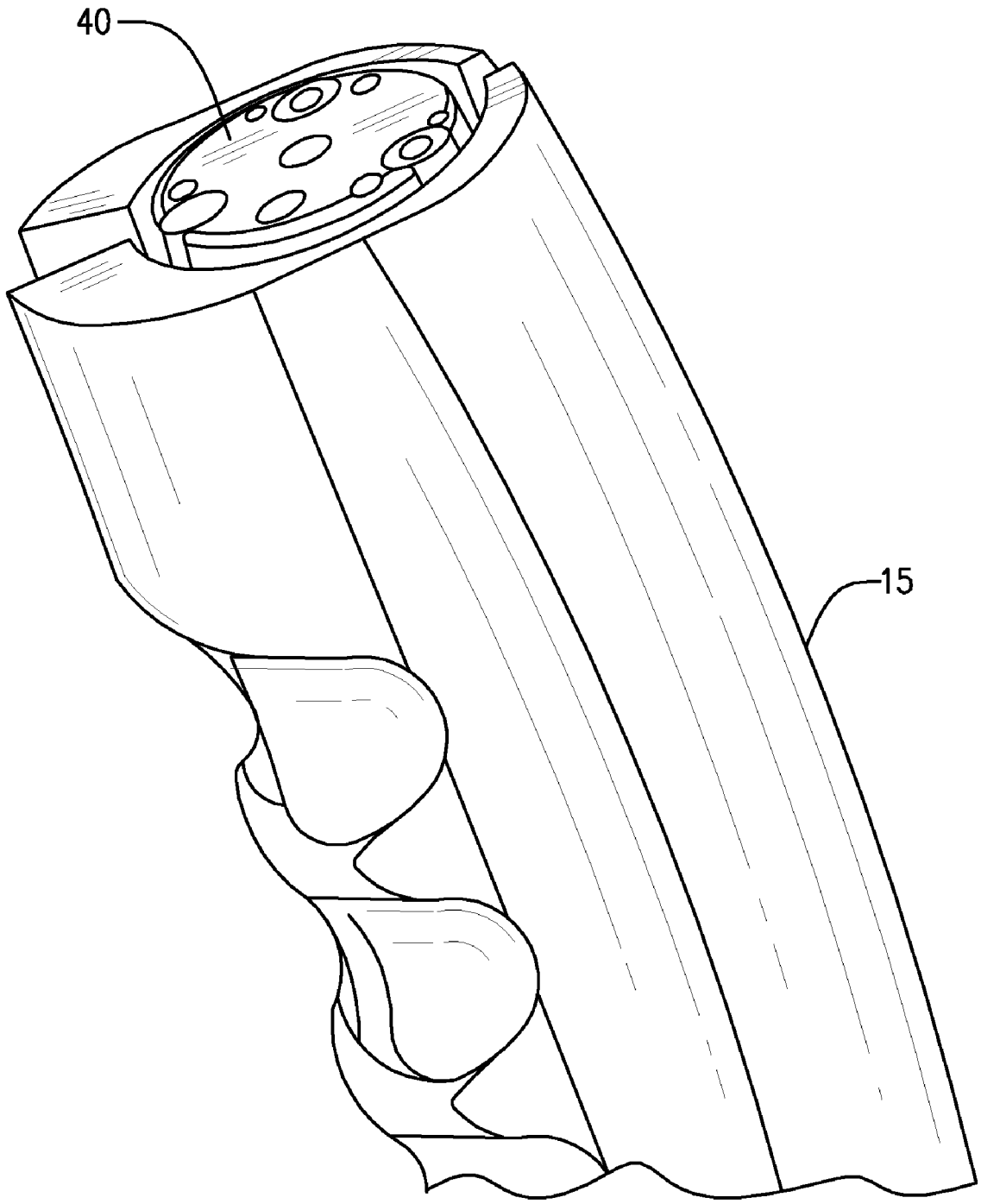
FIG. 1C is an exploded side elevational view of the control module of FIG. 1A.

FIG. 1B is a side view of a weapon (300) showing the control module (10) secured to the weapon's rail attachment (302). In this position, the load sensing cell (40) is active and serves as a sensor for capturing data associated with the forces applied to the control module (10) with respect to the weapon. The abilities of the binary sensor (26) and secondary joystick (28) continue as data input devices to the control module (10).

As shown in FIG. 1A, in addition to the input devices spaced along the vertical body (15), a tactile controller (32) is mounted at or near a bottom surface of the body (15). Movement of the tactile controller by the operator enables the operator to select different modes of operation for the control module (10). Since the controller (32) provides tactile feedback, the operator does not need to view the controller to determine the operation mode selected. Rather, the position of the controller will dictate position data to the operator of the control module (10). In one embodiment wherein the control module is mounted to a weapon, use of the tactile controller (32) enables a soldier to maintain their eyes in a set position while receiving tactile feedback data from the tactile controller (32). In one mode selected through the tactile controller (32), a main sensor controls a processing unit and the secondary joystick (28) controls a payload of a remote apparatus, such as a robotic arm or camera. Similarly, in a second mode selected through the tactile controller (32), the functions of the input sensors (26) may be switched. For example, a main sensor may control payload of a remote apparatus and a secondary joystick (28) may control the remote apparatus. Furthermore, modes may switch functionality of one or more sensors of the module (15). For example, switch between one or more modes of operation may enable the controller to command different payloads or include different combinations of modes.

Figure 2:
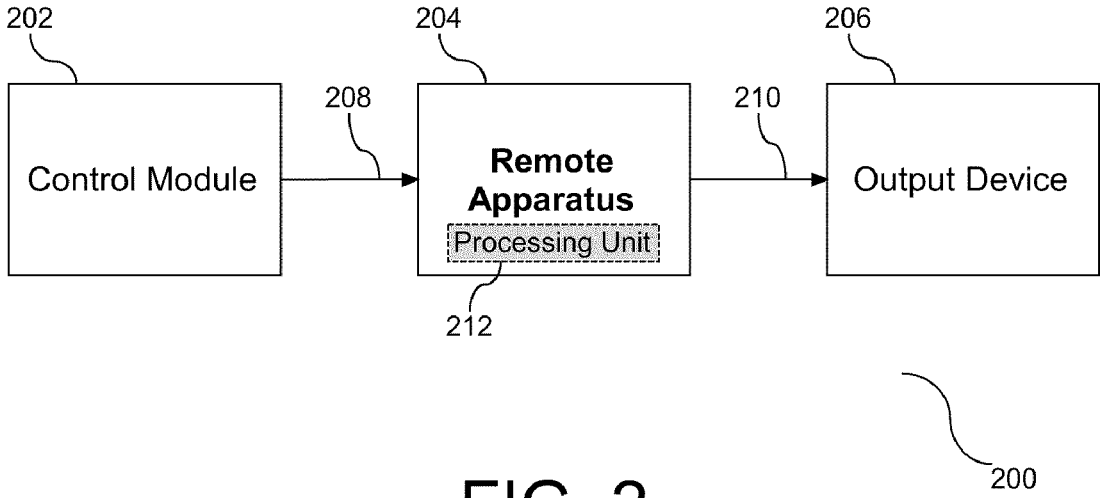
FIG. 2 is a block diagram showing one embodiment of a communication system utilizing the control module.

As noted above, each of the switches, sensors, and joysticks placed along the vertical body (15) forward their data to a processing unit. The processing unit parses the received data and either utilizes the parsed data or transmits the data. FIG. 2 is a block diagram (200) showing a communication system that utilizes the control module shown in FIGS. 1 and 2. As shown, there are three primary elements in the control system. The elements include the control module (202), a remote apparatus (204), and an output device (206). The control module (202) includes the elongate body (15) with some or all of the input devices described and shown in FIGS. 1*a-c*. In one embodiment, a transceiver (504) is coupled to the control module (202). The remote apparatus (204) is a device that is separate from the control module and includes a processing unit (212). In one embodiment, the remote apparatus (204) is in the form of a vehicle, a personal digital assistant, and/or a central processing unit. In one embodiment, the remote apparatus (204) is in wireless communication with the control module (202). Similarly, in one embodiment, the remote apparatus (204) is coupled to a receiver (not shown) to receive data from a communication channel. The output device (206) is separate from both the control module (202) and the remote apparatus (204) and is in communication with the remote apparatus (204). In one embodiment, the output device may be a visual display, a weapon system, a tactile output device, or a remote asset, and the output device may utilize a transceiver (not shown) to support receiving and sending data through communication channels. As shown, there is a uni-directional arrow (208) that originates with the control module (202) and terminates with the remote apparatus (204). Similarly, there is another uni-directional arrow (210) that originates with the remote apparatus (204) and terminates with the output device (206). Each of these arrows (208) and (210) represent uni-directional communication channels among the elements of the communication system. Based upon the utilization of one or more of the input sensors (26), the secondary joystick (28), and/or forces applied to the load sensing cell (40), a signal is created from the received data and digitized. Following digitization of the received data, the signal is wirelessly communicated in a serial stream to the remote apparatus (204) as represented at (208). Similarly, the serial stream received by the remote apparatus (204) is wirelessly communicated to the output device (206).

Figure 3:
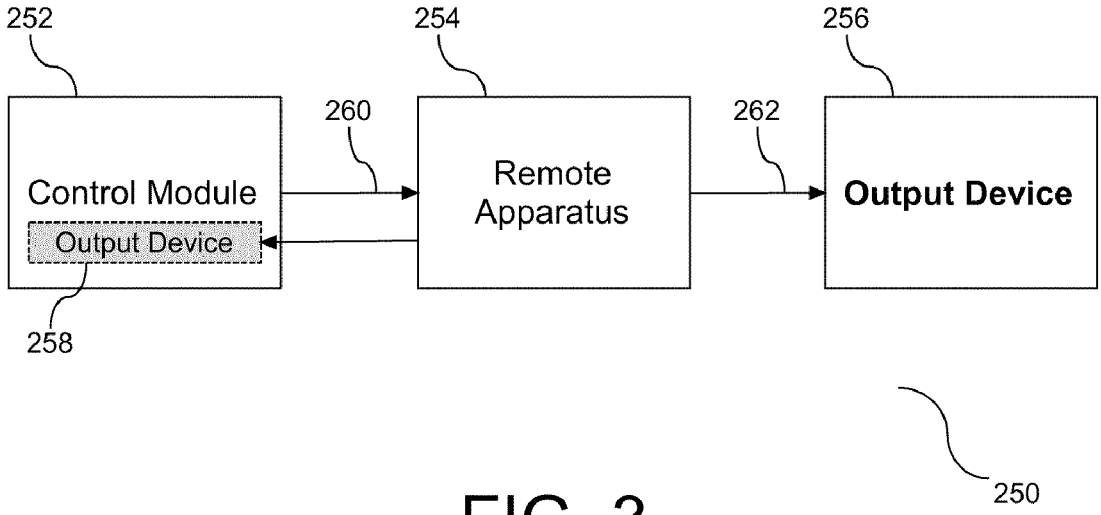
FIG. 3 is a block diagram showing one embodiment of a communication system utilizing the control module.

As shown in FIG. 2, each of the control module (202), the remote apparatus (204), and the output device (206) are independent units that are configured to function in a wireless communication system. FIG. 3 is a block diagram (250) showing an alternative communication system that utilizes the control modules shown in FIGS. 1*a-c*. Similar to the communication system shown in FIG. 2, there is a control module (252) and a remote apparatus (254). In addition, there is a first output device (256) and a second output device (258). Both the first and second output devices (256) and (258) are in wireless communication with the remote apparatus (254). However, the second output device (258) is embedded within the control module (252). Similar to the communication system of FIG. 2, the first output device (256) may be a visual display, a weapon system, a tactile output device, or a remote asset, and the remote apparatus (254) may be a vehicle, a personal digital assistant, and/or a central processing unit. As shown, there is a uni-directional arrow (260) that originates with the control module (252) and terminates with the remote apparatus (254). Similarly, there are two additional uni-directional arrows (262) and (264). The first of these two uni-directional arrows (262) originates with the remote apparatus (254) and terminates with the output device (256). The second of these two uni-directional arrows (264) originates with the remote apparatus (254) and terminates with the output device (258) embedded within the control module (252). Each of these arrows (260), (262), and (264) represent uni-directional communication channels among the elements of the communication system. Based upon the utilization of one or more of the input sensors (26), the miniature joystick (28), and/or forces applied to the load sensing cell (40), a signal is created from the received data and digitized. In one embodiment the signal data is digitized and communicated in a wireless serial stream. However, other means of communicating and transmitting sensor data may be employed, such as a parallel stream. As such, the invention should not be limited to this format of communication. Following digitization of the received data, the signal is wirelessly communicated in a serial stream to the remote apparatus (254) as represented at (260). Similarly, the serial stream received by the remote apparatus (254) is wirelessly communicated to both the independent output device (256) and the output device (258) embedded within the control module (252). The second output device (258) may communicate data to the control module in the form of a visual display to a user in communication with the control module (252). In one embodiment, the second output device (258) may communicate tactile output to the control module by changing the shape and/or contours of the control module when the received transmission signal exceeds a specified threshold value, or does not ascertain a minimum threshold value. At the same time, the same transmission signal may be communicated to the independent output device (256). In one embodiment, the communication transmissions between the control module (252) and the embedded output device (258) may be considered bilateral. Accordingly, the communication system of FIG. 3 supports simultaneous or near-simultaneous communication from the remote apparatus (254) to both the first and second output devices (256) and (258).

Figure 4:
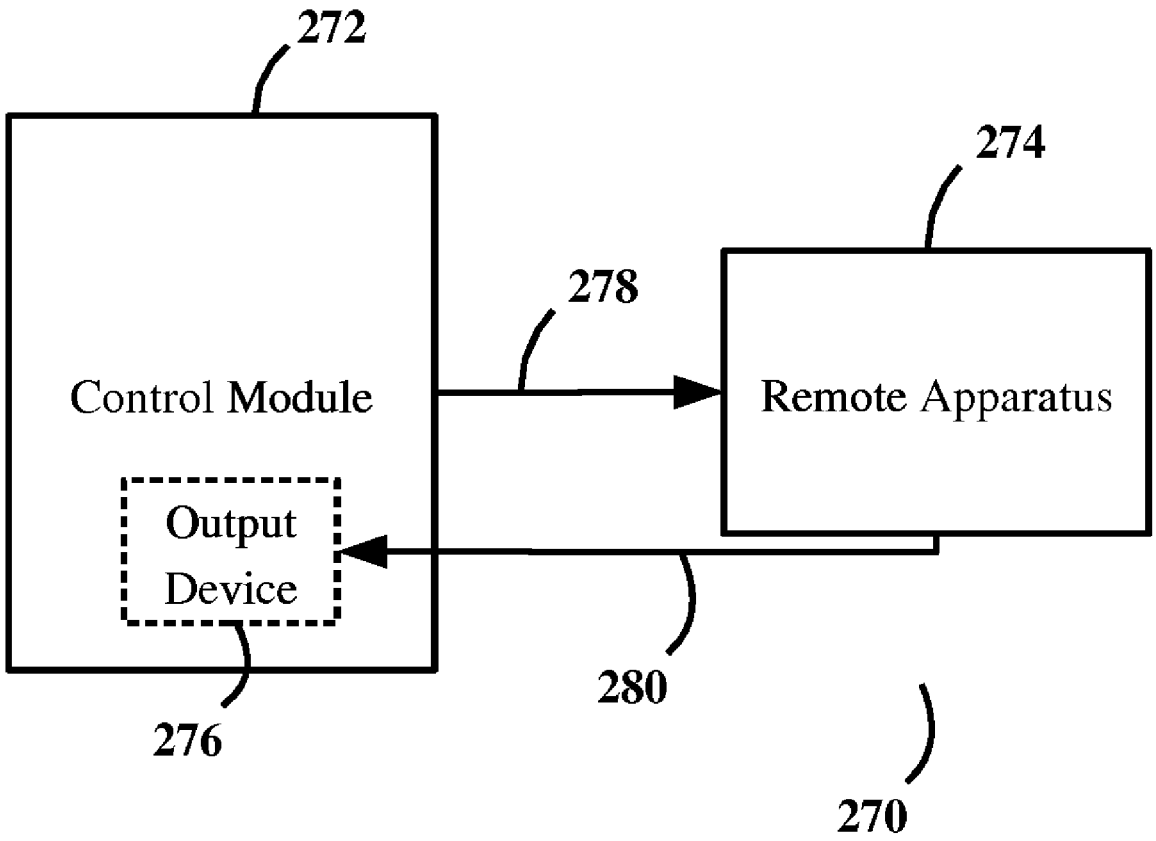
FIG. 4 is a block diagram showing one embodiment of a communication system utilizing the control module.

FIG. 4 is a block diagram (270) of an alternative configuration of a communication system utilizing the control module (272), the remote apparatus (274), and an output device (276). As shown, the remote apparatus (274) is a separate unit from the control module (272). However, the output device (276) is embedded within the control module (272). The are two communication signals shown (278) and (280). The first communication signal (278) emanates with the control module (272) and terminates with the remote apparatus (274). The second communication signal (280) emanates with the remote apparatus and terminates with the output device (276). In one embodiment, the communication transmissions between the control module (272) and the embedded output device (276) may be considered bilateral, as shown at (290). Accordingly, the communication system of FIG. 4 supports bilateral communication between the remote apparatus (274) and the combined control module (272) and output device (276).

The control module (15) with it's load sensing cell (40), binary input sensors (26), secondary joystick (28), and tactile controller (32) improves the ease and utility of using a front weapon mounted controller. When the control module is secured to the rail attachment of the weapon, the load sensing cell (40) together with the binary input sensors (26) and the secondary joystick (28) function to convey data to the remote apparatus. Similarly, the control module (15) may be detached from the weapon and continue to communicate with the remote apparatus. For example, when the control module (15) is detached from or otherwise not attached to the rail of the weapon, the binary input sensors (26) and the secondary joystick (28) continue to convey data to the remote apparatus, however, the load sensing cell (40) becomes disabled. This enables the control module to function as a portable communication tool with the remote apparatus.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

Advantages Over the Prior Art

The control module may be mounted to a rail attachment of a weapon. This configuration enables a soldier or other operator of the weapon to use the control module as both a communication tool and a weapon support element. At such time as the control module is mounted to the rail attachment, the sensors and buttons placed along the body of the module as well as the load sensing cell may be utilized to communicate with an output device through a remote apparatus. Each of the input elements mounted along the length of the body are isometric, i.e. stationary or fixed, thereby making the grip of the control module easy to use as both a stationary handgrip and as a controller. In addition, the load sensing cell located at the interface of the rail attachment and control module body gathers data associated with forces applied to the control module. Thus, the body of the control module is a control input sensor. The combination of the strain gauge together with one or more external sensors mounted along the body of the control module enables the control module to be used as a three axis input apparatus while allowing simultaneous access to control of secondary sensors, a two axis joystick, and a tactile mode selector.

Alternative Embodiments

It will be appreciated that, although specific embodiments of the invention have been described herein for purposes of illustration, various modifications may be made without departing from the spirit and scope of the invention. In particular, the vertical body may be dismounted from the weapon rail attachment and attached to a secondary location. Detachment of the control module body from the weapon rail attachment disconnects functionality of the strain gauge while enabling each of the externally mounts input sensors to remain in communication with the remote apparatus. Additionally, the tactile controller (32) may be used to switch the functionality of one or more of the sensors of the control module. For example, different positions of the tactile controller (32) may enable or disable select sensors, and/or switch communication of data received from a sensor to a different output. In addition, the indentations formed along the body of the control module are set to accommodate both left handed and right handed individuals. In one embodiment, the tactile controller (32) may be in the form of a wheel switch. The term weapon as used herein may be applied to various categories of firearms including, but not limited to, rifles, shoulder launched missiles, sub-machine guns, grenade launchers. Accordingly, the scope of protection of this invention is limited only by the following claims and their equivalents.

We claim:

1. An apparatus comprising:

a control module operable to generate at least one signal for transmission to a processing unit local to a mobile remote apparatus while operating a weapon, the module being mountable on the weapon, the module comprising:

a housing configured as a vertical hand grip for the weapon, the housing having at least one input sensor connected to a processing unit local to the control module to sense presence of one or more fingers;

an electronic communication circuit mounted within the housing;

an input device coupled to an electronic input circuit connected to the processing unit local to the control unit and mounted on the housing such that the operator of the module can simultaneously operate the weapon and provide input to the processing unit; and a transceiver in communication with said processing unit to receive data generated from said input device and transmit data to the remote apparatus, said received and transmitted data conveying tactile information to an output device.

2. The apparatus of claim 1, further comprising a first bi-lateral communication channel operable to transmit a first signal from said control module to a said processing unit local to the remote apparatus, and to transmit a second signal from said processing unit local to the remote apparatus.

3. The apparatus of claim 2, further comprising a second communication channel independent from said first communication channel and operable to communicate data received from said processing unit, local to said remote apparatus, to said output device.

4. The apparatus of claim 3, wherein said housing is removable from said weapon while remaining operable and in communication with said processing unit local to the remote apparatus and said output device.

5. The apparatus of claim 3, wherein said first and second communication channels are wireless.

6. The apparatus of claim 1, further comprising a visual output mounted separate from said housing and moveable from a stored position to a view position, said visual output operable to display data received from a first communication channel.

7. The apparatus of claim 1, further comprising a strain gauge mounted in said module to provide proportional input data to the processing unit local to the control unit.

8. The apparatus of claim 7, wherein said proportional input data detects firing of said weapon and translates said firing to said processing unit local to the control unit.

9. The apparatus of claim 1, further comprising at least one of the input sensors being a capacitive sensor in communication with said housing to control delivery of a transmission signal to said processing unit when force applied to said housing exceeds a minimum threshold.

10. The apparatus of claim 1, further comprising a button recessed in said housing to allow use of said housing as a handgrip for said weapon with reduced usability interference.

11. The apparatus of claim 1, further comprising a tactile mode selector mounted to said housing to allow selection of different control modes of said processing unit.

12. The apparatus of claim 1, said tactile information is in the form of vibration of the housing.

13. The apparatus of claim 1, further comprising a combination of at least two input sensors actuated to activate the control module.

14. A communication system comprising:

a transceiver coupled to a control module mountable to a weapon;

said control module communicating with a mobile remote apparatus through said transceiver;

a processing unit local to the control module;

an input device coupled to said control module, said input device operated by an operator;

the input device to sense presence of at least one finger;

the control module to support simultaneous operation of said weapon and said processing unit responsive to the sensed presence of the at least one finger; and tactile output in communication with said transceiver to convey control feedback information in response to a signal received from said transceiver.

15. The system of claim 14, further comprising said input device to change a mode of operation of one or more sensors.

16. The system of claim 14, further comprising a first unilateral communication channel from said control module to a remote apparatus.

17. The system of claim 14, further comprising a second unilateral communication channel from a remote apparatus to said output device.

18. The system of claim 14, further comprising a bi-directional channel between said control module and a remote apparatus.

* * * * *